US009115928B2

(12) United States Patent
Akalan et al.

(10) Patent No.: US 9,115,928 B2
(45) Date of Patent: Aug. 25, 2015

(54) HOME APPLIANCE COMPRISING A TRANSFER ELEMENT BETWEEN A BODY AND A DOOR THEREOF

(71) Applicant: BSH BOSCH UND SIEMENS HAUSGERÄTE GMBH, München (DE)

(72) Inventors: Yigit Akalan, Tekirdag (TR); Menekse Gizem Saygi, Istanbul (TR); Tanzer Yildizgöcer, Tekirdag (TR)

(73) Assignee: BSH HAUSGERÄTE GMBH, Munich (DE)

( * ) Notice: Subject to any disclaimer, the term of this patent is extended or adjusted under 35 U.S.C. 154(b) by 0 days.

(21) Appl. No.: 14/152,257

(22) Filed: Jan. 10, 2014

(65) Prior Publication Data

US 2014/0210328 A1 Jul. 31, 2014

(30) Foreign Application Priority Data

Jan. 30, 2013 (TR) ..... a 2013 01119

(51) Int. Cl.

| | |
|---|---|
| ***A47B 96/04*** | (2006.01) |
| ***F25D 23/02*** | (2006.01) |
| ***E05D 7/00*** | (2006.01) |
| *E05D 11/00* | (2006.01) |

(52) U.S. Cl.

CPC ..... *F25D 23/028* (2013.01); *E05D 7/00* (2013.01); *E05D 11/0081* (2013.01); *F25D 2323/024* (2013.01); *F25D 2400/40* (2013.01)

(58) Field of Classification Search

CPC ..... F25D 2400/40; F25D 23/028; F25D 2323/024; E05D 11/0081; E05D 7/00

USPC ..... 312/405, 325, 326–329, 223.6; 16/368

See application file for complete search history.

(56) References Cited

U.S. PATENT DOCUMENTS

| | | | | | |
|---|---|---|---|---|---|
| 3,848,361 | A * | 11/1974 | Foster et al. | 49/167 |
| 4,625,936 | A * | 12/1986 | Hadden, Sr. | 248/544 |
| 5,039,828 | A * | 8/1991 | Marks et al. | 174/135 |
| 5,471,709 | A * | 12/1995 | Lanzani | 16/238 |
| 5,893,539 | A * | 4/1999 | Tran et al. | 248/68.1 |
| 6,350,956 | B1 * | 2/2002 | Sakata | 174/101 |
| 6,896,344 | B2 * | 5/2005 | Tsutsumi et al. | 312/330.1 |
| 7,530,825 | B2 * | 5/2009 | Sato et al. | 439/162 |
| 7,698,785 | B2 * | 4/2010 | Bennett | 16/369 |
| 7,848,094 | B2 * | 12/2010 | Wang et al. | 361/679.28 |
| 7,959,453 | B2 * | 6/2011 | Guering | 439/165 |
| 8,366,220 | B2 * | 2/2013 | Oberhauser et al. | 312/405 |
| 8,474,100 | B2 * | 7/2013 | Vanini | 16/286 |
| 8,887,355 | B2 * | 11/2014 | Kleemann et al. | 16/384 |
| 2006/0017361 | A1 * | 1/2006 | Rendel et al. | 312/405 |
| 2007/0251261 | A1 * | 11/2007 | Son et al. | 62/390 |
| 2008/0276422 | A1 * | 11/2008 | Beckmann et al. | 16/258 |
| 2010/0176701 | A1 * | 7/2010 | Oberhauser et al. | 312/405 |

(Continued)

*Primary Examiner* — Janet M Wilkens
*Assistant Examiner* — Hiwot Tefera
(74) *Attorney, Agent, or Firm* — Nixon & Vanderhye, P.C.

(57) ABSTRACT

A home appliance, e.g., a refrigerator, includes a body; a door connected to the body with a hinge; a transfer element provided between the body and the door; and a guiding device guiding the transfer element between the body and the door. The guiding device includes a body element fixed to the body; a door element fixed to the door; and at least one bridge element pivotally connected to the body element and the door element as compatible with the movement of the hinge and guiding the transfer element between the body element and the door element.

32 Claims, 7 Drawing Sheets

(56) References Cited

U.S. PATENT DOCUMENTS

2010/0269293 A1* 10/2010 Wisniewski ..... 16/250
2012/0242207 A1* 9/2012 Mershon et al. ..... 312/237
2013/0257238 A1* 10/2013 Herron et al. ..... 312/209

* cited by examiner

HOME APPLIANCE COMPRISING A TRANSFER ELEMENT BETWEEN A BODY AND A DOOR THEREOF

This application claims priority to Turkey Patent Application No. 2013/01119 filed 30 Jan. 2013, the entire contents of which is hereby incorporated by reference.

TECHNICAL FIELD

The present invention relates to a home appliance and particularly relates to a refrigerator comprising a body and a door pivotally connected to said body; and a transfer element like a cable or a pipe between the body and the door.

PRIOR ART

In some home appliances in the present art, fluid transfer is required from the home appliance body to the door or from the door to the body. For instance, in some refrigerators, water is supplied from the body to the water dispenser provided at the door. Or the water, accumulated in the waste water compartment of the water dispenser, is transferred to a chamber or to a drain provided in the body. In this case, a transfer element like a pipe should be used between the door and the body.

Again, in most of the home appliances provided in the present art, mechanisms requiring power, for instance like control panel, screen, heating resistance, etc., are provided on the door connected to the home appliance body. Said power is generally supplied by the power supply connected to the body or provided in the body. Therefore, there is a cable or a similar transfer element between the body and the door.

Said transfer elements like cable or pipe can remain between the body and the door during opening and closing of the door. Therefore, closing of the door can be prevented and the transfer element may be damaged physically. This affects operation of the home appliance in a negative manner. Moreover, the transfer element, which can be accessed easily, can be damaged by incompetent persons.

There are some embodiments in the present art for providing a solution to the described problems. As an example to this, the arrangement described in the document US 2010/176701 A1 can be given. Accordingly, the arrangement transfers a cable, exiting out of the body of a home appliance or a furniture element, to a hinged door. The arrangement includes at least one first holding member and at least one second holding member for guiding the cable. The first and second sections of the hinge are movable with respect to each other and provide opening and closing of the door. The cable is held on the hinge by means of the holding members in a manner not preventing closing of the door. However, in the document, there is no information of usage of the arrangement without the hinge.

OBJECT OF THE INVENTION

The object of the present invention is to provide a home appliance where no hinge is needed for positioning the transfer element provided between the body and the door.

In order to reach said object, the present invention is a home appliance, particularly a refrigerator, comprising a body; a door connected to the body with a hinge; a transfer element provided between the body and the door; and a guiding device guiding the transfer element between the body and the door; and that the guiding device comprises a body element fixed to the body; a door element fixed to the door; and at least one bridge element connected to the body element and the door element as compatible with the movement of the hinge and guiding the transfer element between the body element and the door element. Thus, the transfer element is carried between the door and the body by means of a guiding device carried by the door and by the body. A hinge is not needed for assembling the mechanism to the home appliance. Moreover, the transfer element is guided from the body to the door without preventing closing of the door, without giving damage and in a visually hidden manner.

In a preferred embodiment of the present invention, the guiding device comprises more than one bridge element pivotally connected to each other in series such that the first bridge element of the series of bridge elements is pivotally connected to the body element and the last bridge element of the series of bridge elements is pivotally connected to the door element. Thus, in home appliances having a door opened by means of a movement different from pivoting known in the related art or having pluralities of pivoting points, the transfer element can be guided.

In a preferred embodiment of the present invention, the guiding device comprises a connector providing the connection at at least one connection point of the guiding device. Thus, it becomes possible that one of the two elements connected to each other and particularly one of the two elements connected in a pivotal manner can pivot 180 degrees with respect to the other one. The reason of that, in some embodiments of the guiding device, the elements shall become parallel with respect to each other by means of pivotal movement. However, due to the structure of the elements, rotation of 180 degrees is not possible when the elements are connected to each other directly. Moreover, since the transfer element is folded by following an arc with a wide diameter, the fatigue on the transfer element is minimized thanks to the structure of the connector.

In a preferred embodiment of the present invention, the body element and/or the door element comprises a pin housing or a pin providing connection with the bridge element. Additionally, the connector comprises a pin housing or a pin providing connection with the bridge element and/or body element and/or door element. Moreover, the bridge element comprises a pin or a pin housing provided on at least one end of the bridge element. Thus, the axial connection between the body element, bridge element, connector and the door element is provided without the need for additional element and for additional cost.

In a preferred embodiment of the present invention, the pin housing comprises a strength element provided around the pin housing. Thus, in the elements made of a material whose strength is low, the pin housing is provided to be more resistant and to have a longer lifetime. Since material is used only in the region where strength is required, the production costs are lowered.

In a preferred embodiment of the present invention, the upper face of the pin is inclined. Thus, during the assembly, the wall having the pin housing slides on the upper face of the pin. This facilitates the assembly process.

In a preferred embodiment of the present invention, a face of the bridge element comprising the pin or the pin housing is longer than a face of the bridge element not comprising the pin or the pin housing; and excess part of the longer face of the bridge element comprises the pin or the pin housing. Thus, while the door is brought to the closed position, the transfer element is prevented from being squeezed and damaged between the bridge element and another element connected thereto. Moreover, said excess part can bend during assembly and it facilitates the assembly process.

In a preferred embodiment of the present invention, the body element comprises a groove guiding the transfer element from the body to the bridge element connected to the body element. Thus, the groove remaining between the body and the body element forms a pipe-like structure for the transfer element. Since the body is used for the pipe-like structure, in the present invention, the material costs are kept at a low level. At the same time, the molding process used for obtaining the grooved body element can be realized in an easy and rapid manner.

In a preferred embodiment of the present invention, the door element comprises a groove guiding the transfer element from the bridge element connected to the door element to the door. Thus, the groove, remaining between the door and the door element, forms a pipe-like structure for the transfer element. Since the door is used for the pipe-like structure, in the present invention, the material costs are kept at a low level. At the same time, the molding process used for obtaining the grooved door element can be realized in an easy and rapid manner.

In a preferred embodiment of the present invention, the groove comprises a C-shaped support element holding the transfer element in the groove. Thus, the transfer element is kept inside the housing. Moreover, since the support element is obtained in an orthogonal manner with respect to the walls of the housing, it supports the strength of the walls. This leads to less material usage and lower cost.

In a preferred embodiment of the present invention, the body element comprises a connection section to connect the body element to the body. Thus, the guiding device can be carried on the body without needing a hinge carrying the guiding device.

In a preferred embodiment of the present invention, the door element comprises a connection section to connect the door element to the door. Thus, the guiding device can be carried on the door without needing a hinge carrying the guiding device.

In a preferred embodiment of the present invention, the bridge element has a pipe-like form guiding the transfer element. Thus, when the door is in open position, direct physical and visual access to the transfer element is prevented. This prevents incompetent persons or harmful external effects from accessing the transfer element and provides positive contribution to the usage lifetime of the transfer element.

In a preferred embodiment of the present invention, the transfer element is a cable and/or a pipe. Thus, optionally, a fluid as water or power can be provided to an element provided on the door.

In a preferred embodiment of the present invention, the body element and/or the door element comprises a bridge housing in that the bridge element is disposed when the door is in closed position. Thus, when the door is in closed position, access to the bridge element is prevented. Moreover, in a preferred embodiment, the pin or the pin housing providing axial connection is provided on the walls of the bridge housing, the bridge element connected to the body element and/or to the door element can realize 180 degrees of pivotal movement with respect to the body element and/or with respect to the door element. Thus, when the door is in closed position, the bridge element can become parallel with respect to the body element and/or to the door element. By means of this, since the transfer element is folded by following an arc with a wide diameter, the fatigue on the transfer element is minimized.

DETAILED DESCRIPTION OF THE INVENTION

Figure 1:
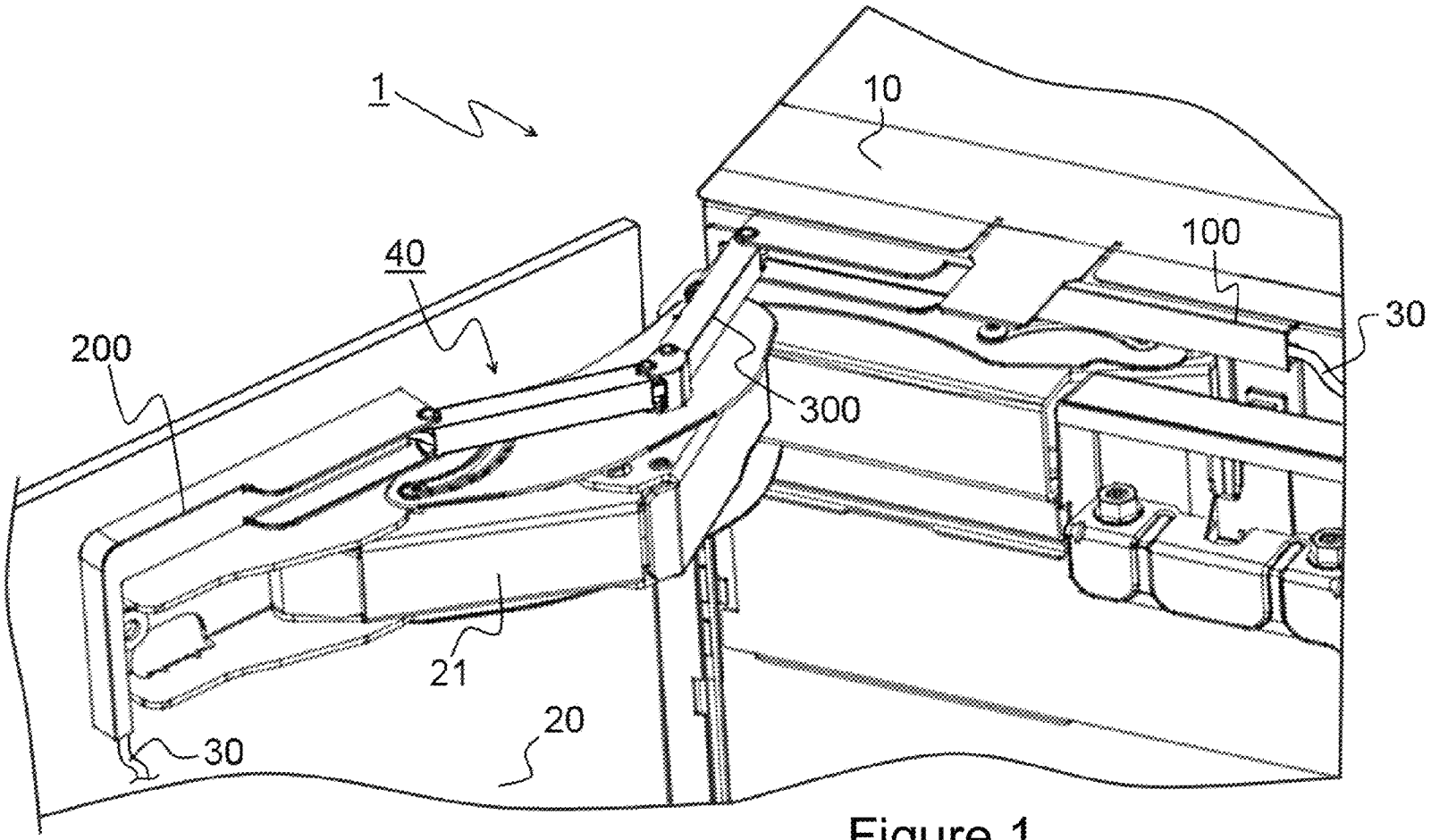
In FIG. 1, the view of the home appliance having a guiding device and whose hinged door is in open form is given. The home appliance is viewed from the upper front side. The upper section of the home appliance is illustrated partially.

In this detailed description, the preferred embodiments of the subject matter home appliance (1), particularly of a refrigerator are explained in the light of the annexed figures without forming any restrictive effect in order to make the subject more understandable. The direction statements like front, upper and bottom described in this document are stated with referencing the viewed section of the body (10) of the home appliance (1) presented in FIG. 1 as the "front" section of the body (10). Moreover, when the door (20) of the home appliance (1) is accessed by considering only itself, the section of the door (20) illustrated in FIG. 1 is referenced as the "front" section of the door (20).

The present invention relates to a home appliance (1), particularly relates to a refrigerator comprising a body (10); a door (20) connected to the body (10) by means of a hinge (21); a transfer element (30) extending between the body (10) and the door (20); and a guiding device (40) guiding the transfer element (30) between the body (10) and the door (20).

Figure 2:
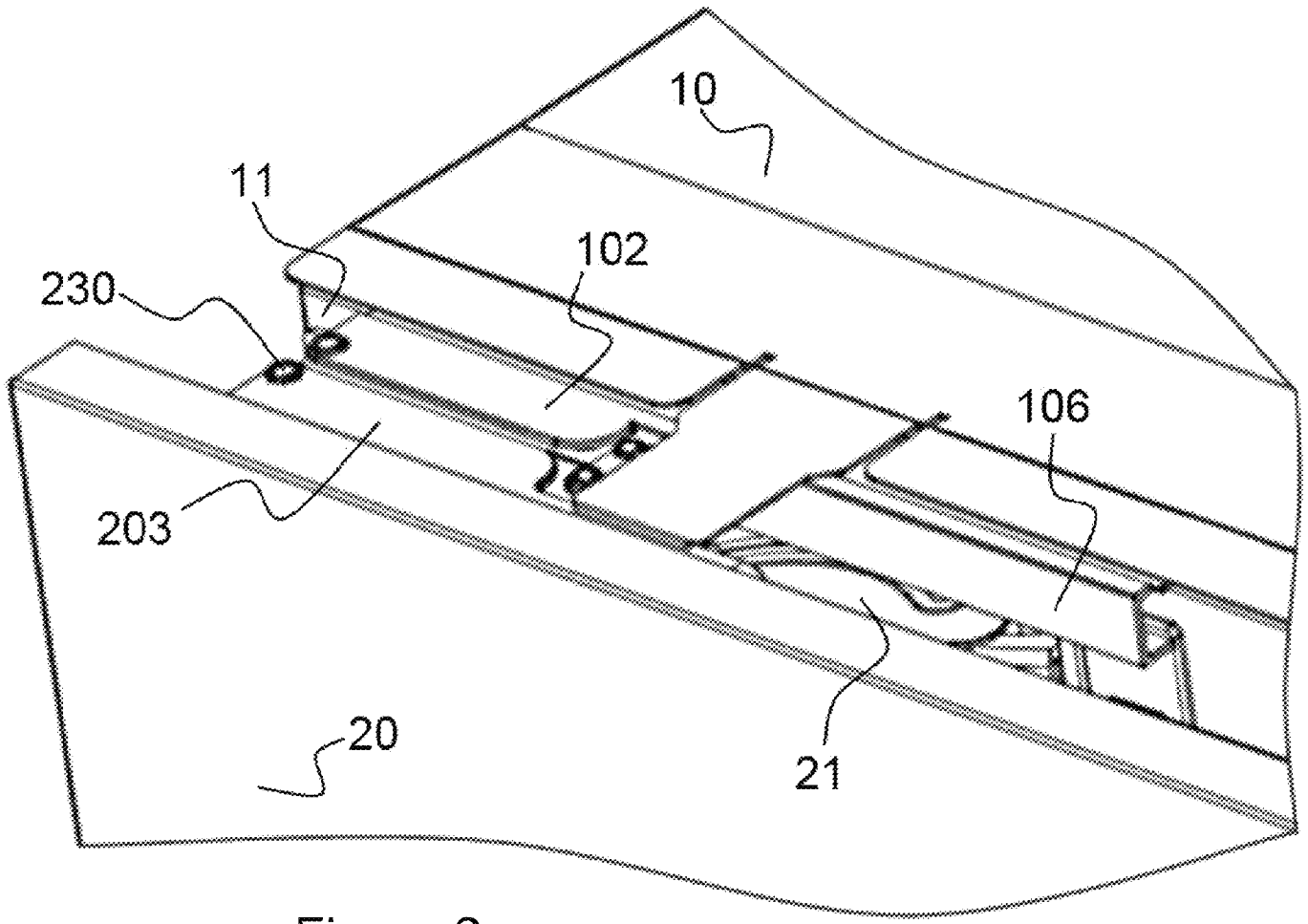
In FIG. 2, the view of the home appliance having a guiding device and whose hinged door is in closed form is given. The home appliance is viewed from the upper front side. The upper section of the home appliance is illustrated partially.

In FIG. 1, the left door (20) wing and the body (10) of a two-door refrigerator presented as example to the subject matter home appliance (1) are illustrated. The door (20) is in open position. In the example home appliance (1), the hinge (21) has three pivot points such that there is one each pivot points on the doors (20) and there is one pivot point on the body (10). Thus, when the door (20) passes to closed position as in FIG. 2, it roughly takes the form of Z shape. The preferred embodiment of the guiding device (40) comprises three pivot points or in other words three folding points in a similar manner to the hinge (21). However, if the design allows, the hinge (21) or the guiding device (40) may have less than three or more than three pivot points.

Even if the guiding device (40) is positioned just above the hinge (21) in the preferred home appliance (1), the guiding device (40) does not need a hinge (21) for assembly to the home appliance (1) as described above and as exemplified in the figures. Since, the guiding device (40) comprises a body element (100) fixed to the body (10), a door element (200) fixed to the door (20), a bridge element (300) carried by them or pluralities of bridge elements (300) connected in a series manner so as to make pivoting movement.

Figure 3:
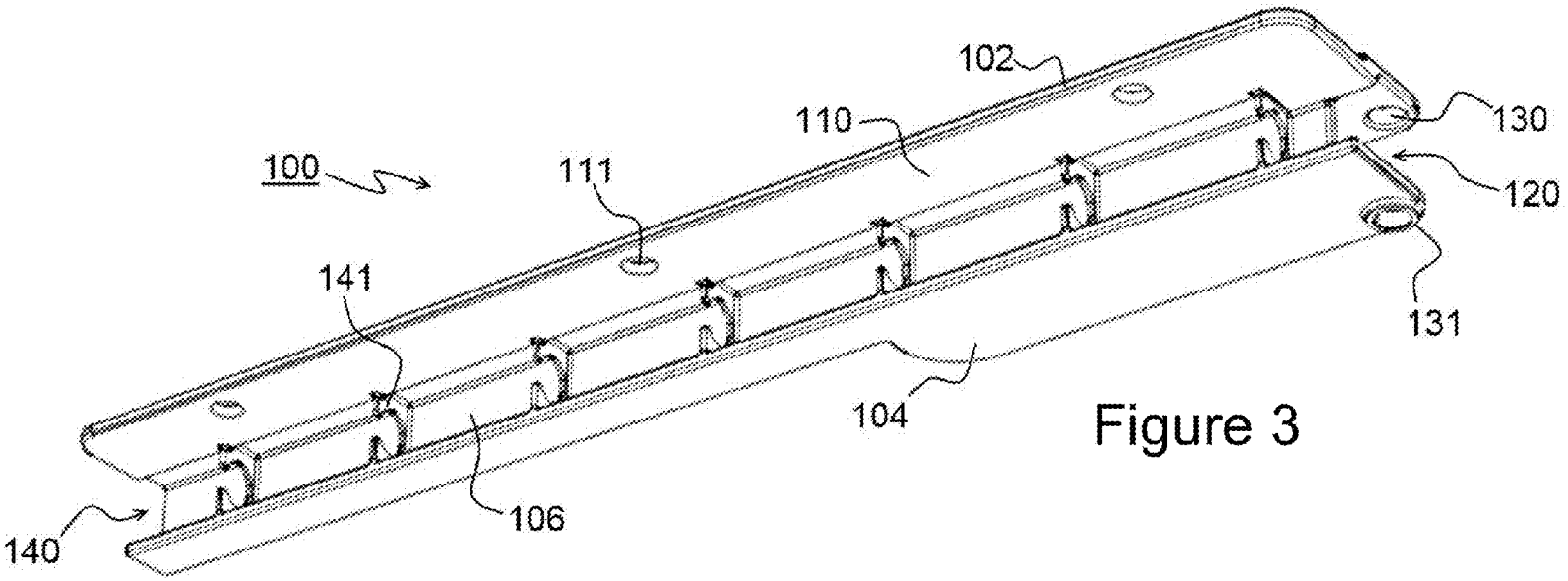
In FIG. 3, the isometric view of the body element of the guiding device is given. The body element is viewed from the bottom rear side.

In FIG. 3, the preferred body element (100) embodiment is illustrated. In a compliant manner, the body element (100) is a long and linear element. Roughly, it comprises two parallel plates as the bottom face (104) and the upper face (102) and a wall (106) between them provided in an orthogonal manner with respect to them. The upper face (102) comprises a connection section (110) providing fixation to the body (10). The connection section (110) is preferably a plate extending along the body element (100). There is one or more than one connection hole (111) thereon. It is fixed to the front frame (11) of the body (10) by means of a screw and a similar fixation element through the connection hole (111). In other words, the body element (100) extends in a parallel manner with respect to the upper edge of the body (10).

The upper face (102), the bottom face (104) and the wall (106) form a groove (140) on the side facing the body (10). This groove (140) provides the transfer element (30) to be guided from the body (10) to the bridge element (300). After the body element (100) is fixed to the body (10), the open face of the groove (140) is covered by the front frame (11). Thus, the transfer element (30) is hidden in a channel like a pipe whose four sides are closed.

In the preferred embodiment, there is a C-shaped support element (141) inside the groove (140). The support element (141) preferably comprises an inner gap having a width wherein a cable known in the related art can be placed. The support element (141) is in the form of a plate extending between the upper face (102) and the bottom face (104) in an orthogonal manner with respect to said faces. When the plate is viewed from the front side, the C form can be seen. There are preferably pluralities support elements (141) at certain intervals along the groove (140) (FIG. 3). The support element (141) provides the transfer element (30) to be kept inside the groove (140). Moreover, since it extends between the upper face (102) and the bottom face (104) in an orthogonal manner, it supports the strength of both of said faces.

There is a bridge housing (120) on the side of the wall (106) of the body element (100) which is opposite with respect to the groove (140). The bridge housing (120) is formed by the parts of the upper face (102) and of the bottom face (104) remaining on the other side of the wall (106) with respect to the groove (140). The bridge housing (120) is formed by the wall (106) and by means of the upper face (102) and the bottom face (104) (FIG. 3). The single lateral face and the ends of the bridge housing (120) are open like the groove (140). The bridge housing (120) is preferably a housing having the same length as the bridge element (300). There is a pin housing (130) or a pin on the upper face (102) and on the bottom face (104) forming the bridge housing (120), providing direct or indirect connection with the bridge element (300). In the preferred embodiment, the bridge element (300) is directly connected to the body element (100). Therefore, in order for the guiding device (40) to be folded completely (FIG. 9), there has to be a sufficient gap around the rotation axis. For this reason, the pin or the pin housing (130), preferably the pin housing (130) is positioned at the corner, where the open face of the bridge housing (120), and the end of the body element (100), where the bridge element (300) is connected, intersect (FIG. 3).

Figure 4:
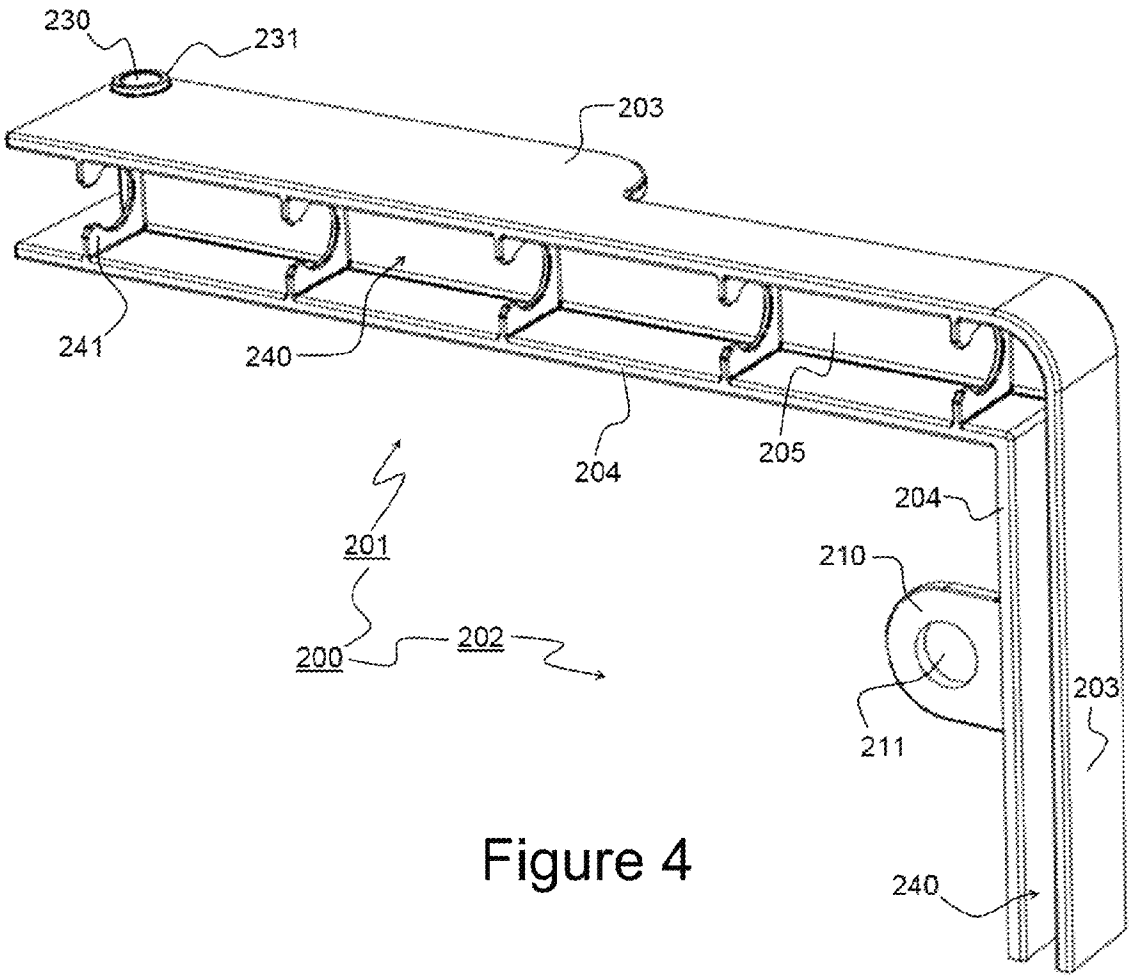
In FIG. 4, the isometric view of door element of the guiding device is given. The door element is viewed from the upper rear side.

The preferred door element (200) is illustrated representatively in FIG. 4. The door element (200) has a first section (201) and a second section (202). The first section (201) and the second section (202) are preferably in one-piece form. The first section (201) has the same structure as the body element (100), it is long and linear. The only difference is that the first section (201) is shorter than the second section (202) in length. In a compliant manner to this, the two parallel plates as the bottom face (204) and the upper face (203) comprise a wall (205) in between which is orthogonal with respect to said faces. However, there is not a connection section (210) on the upper face (203). However, the first section (201) may comprise one or more than one connection sections (110) optionally.

The upper face (203), the bottom face (204) and the wall (205) form a groove (240) on the side facing the door (20). This groove (240) provides the transfer element (30) to be guided from the bridge element (300) to the door (20). After the door element (200) is fixed to the door (20), the open face of the groove (240) is closed by the door (20). Thus, the transfer element (30) is hidden in a channel whose four sides are closed and which is similar to a pipe.

In the preferred embodiment, there is a C-shaped support element (241) inside the groove (240). The support element (241) preferably comprises an inner gap having a width wherein a cable known in the related art can be disposed. The support element (241) is in the form of a plate between the upper face (203) and the bottom face (204) and it extends orthogonally with respect to said faces. When the plate is viewed from the front, the C form can be seen. Preferably, there are pluralities of support elements (241) at certain intervals along the groove (240) (FIG. 4). The support element (241) provides the transfer element (30) to be held inside the groove (240). Moreover, since it extends in an orthogonal manner between the upper face (203) and the bottom face (204), it supports the resistance of both these faces.

Figure 9:
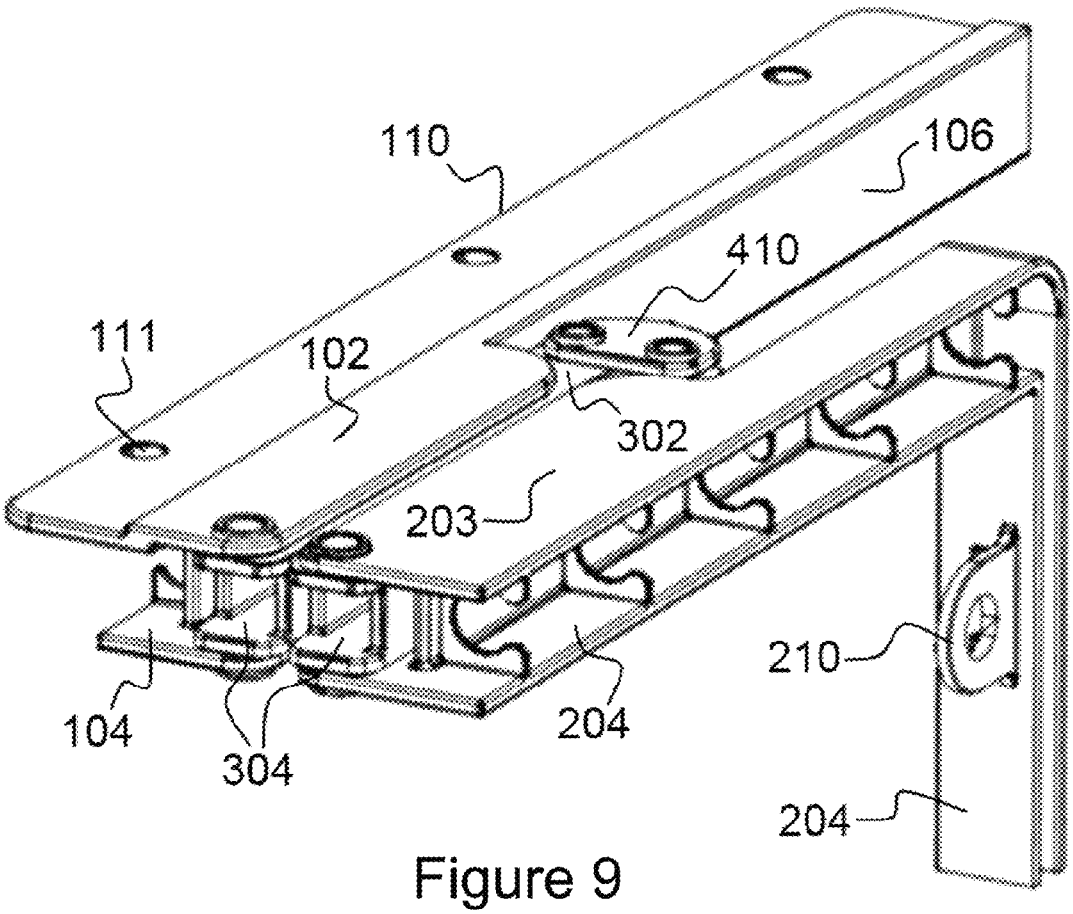
In FIG. 9, the frontal isometric view of the guiding device in closed position is given. The home appliance and the hinge are not illustrated.

There is a bridge housing (220) on the side of the wall (205) of the door element (200) opposite with respect to the groove (240). The bridge housing (220) is formed by means of the portions of the upper face (203) and of the bottom face (204) which remain on the other side of the wall (205) opposite with respect to the groove (240). The bridge housing (220) is formed by the upper face (203) and the bottom face (204) and the wall (205) (FIG. 4). One lateral face and the ends of the bridge housing (220) are open in a similar manner to the groove (240). The bridge housing (220) is a housing which preferably has the same length as the bridge element (300). There is a pin housing (230) or a pin, providing direct or indirect connection with the bridge element (300), on the upper face (203) and the bottom face (204) forming the bridge housing (220). In the preferred embodiment, the bridge element (300) is directly connected to the door element (200). Therefore, there has to be sufficient gap around the rotation axis in order for the guiding device (40) to be completely folded (FIG. 9). For this reason, the pin or the pin housing (230), preferably the pin housing (230), is positioned at the corner where the open face of the bridge housing (220) and the end of the door element (200), the bridge element (300) is connected thereto, intersect (FIG. 4).

Figure 8:
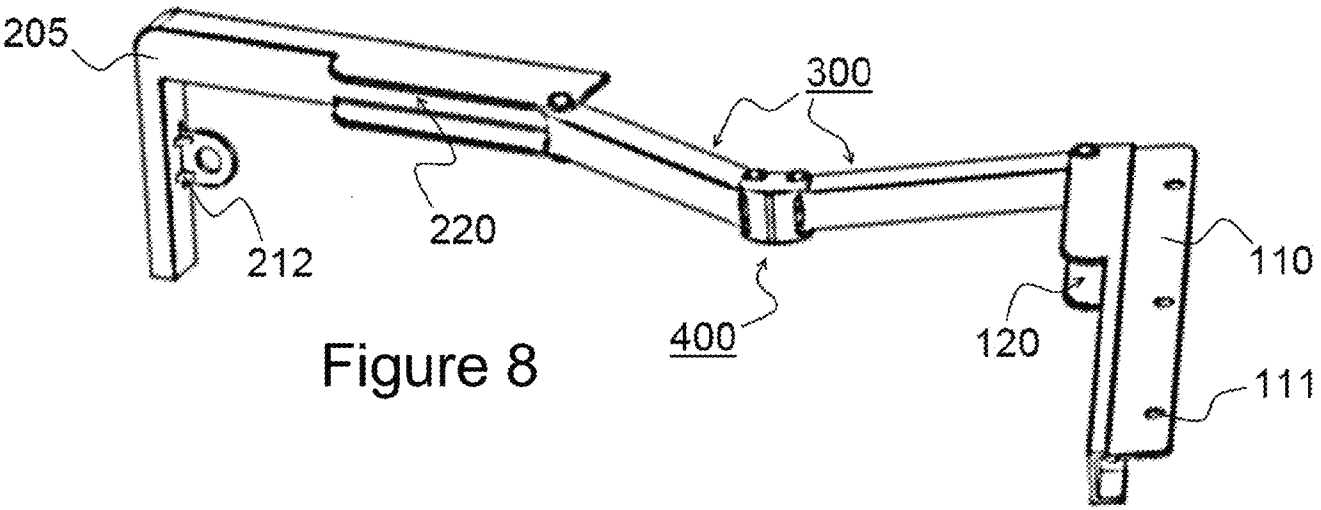
In FIG. 8, the isometric view of the front section of the guiding device which is preferably visible by the user is given. The home appliance and the hinge are not illustrated.

The second section (202) of the door element (200) is preferably orthogonal with respect to the first section (201) and parallel with respect to the lateral edge of the door (20). The second section (202) is structurally like the continuation of the first section (201). For this reason, the upper face (203), the bottom face (204) and the wall (205) continue in a structural manner, and extend in a slightly orthogonal direction by drawing an arc of 90 degrees. However, preferably the upper face (203) draws an arc in an earlier manner than the bottom face (204). Therefore, the groove (240) obtains a form having a width such that only a transfer element (30) is placed. For this reason, there is no support element (241) therein (FIG. 4). The upper face (203) and the bottom face (204) preferably do not extend towards the other side of the wall (205) with respect to the door (20) (FIG. 8).

There is preferably one connection section (210) of the door element (200) and it is preferably provided in the second section (202). The connection section (210) is a plate in ring form provided in an orthogonal manner with respect to the bottom face (204) at the side of the bottom face (204) remaining outside of the groove (240). Thus, a connection hole (211) is formed. The door element (200) is fixed to the door (20) by means of a fixation element like a screw and similar element through the connection hole (211). Optionally, more than one connection section (210) can be formed. The connection section (210) comprises one or more than one support wall (212) between the bottom face (204) and the connection section (210) in order to increase resistance (FIG. 8).

In the home appliance (1) presented in the figures, a fixation element passing through the connection section (210) provides the connection of the hinge (21) to the door (20). However, this does not mean that a hinge (21) is needed for fixing the door element (200) to the door (20). The door element (200) can be fixed to the door (20) without the hinge (21).

Figure 5:
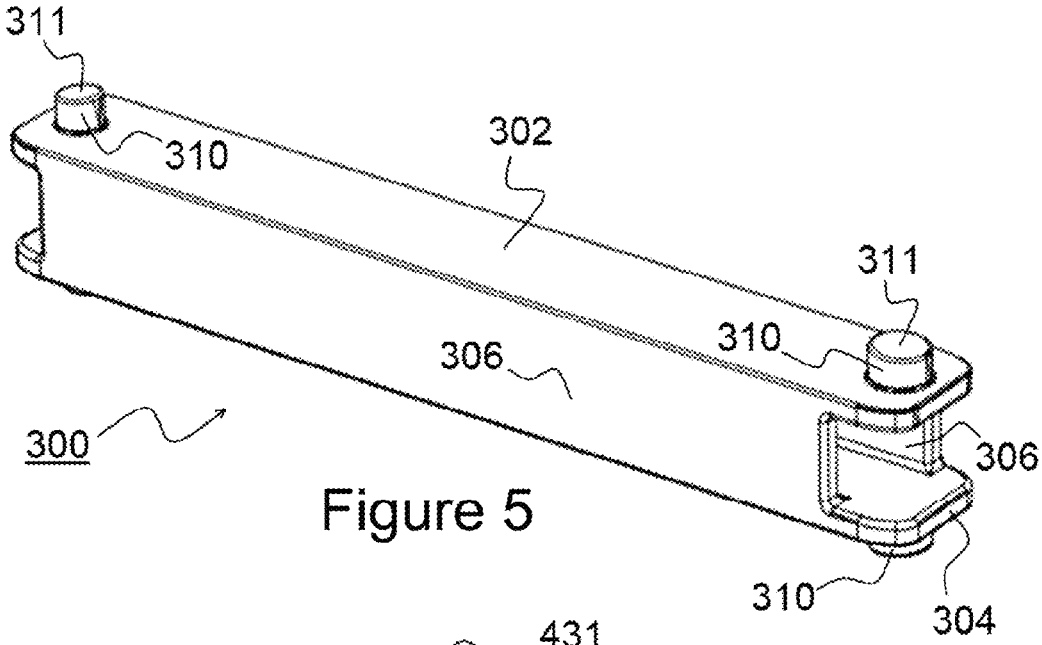
In FIG. 5, the isometric view of the bridge element of the guiding device is given.

In FIG. 5, the preferred embodiment of the bridge element (300) is illustrated. The bridge element (300) preferably comprises an upper face (302), a bottom face (304) and two mutual lateral faces (306) in a pipe-like manner. The bridge element (300) has a rectangular cross section. It is long and linear; however, it is preferably shorter than the first section (201) of the door element (200) and of the body element (100). The transfer element (30) can pass therethrough easily. The bridge element (300) can accommodate the transfer element (30) which is longer than the bridge element (300) in order for the bending in the transfer element (30) to be unproblematic during folding of the guiding device (40).

The bridge element (300) comprises a pin (300) or a pin housing provided on at least one end thereof. In the preferred embodiment, there is one each pins (310) on both ends of the bridge element (300) at the upper face (302) and at the bottom face (304). The upper face (302) and the bottom face (304) of the bridge element (300) are longer than the lateral faces (306). The pin (310) is provided at this long section, in other words, it is provided in the excess sections with respect to the lateral faces (306). Preferably, the length of the excess section is equal to the diameter/width of the pin (310).

Figure 6:
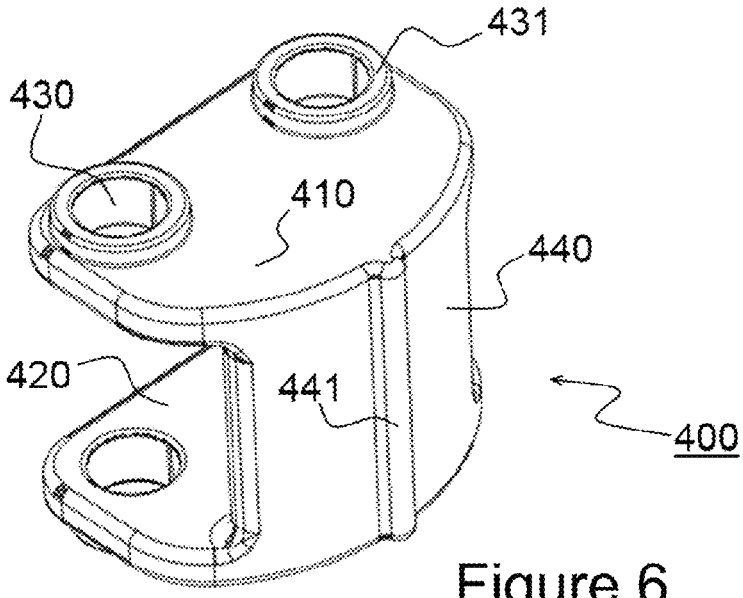
In FIG. 6, the isometric view of the connector of the guiding device from the upper section is given.
Figure 7:
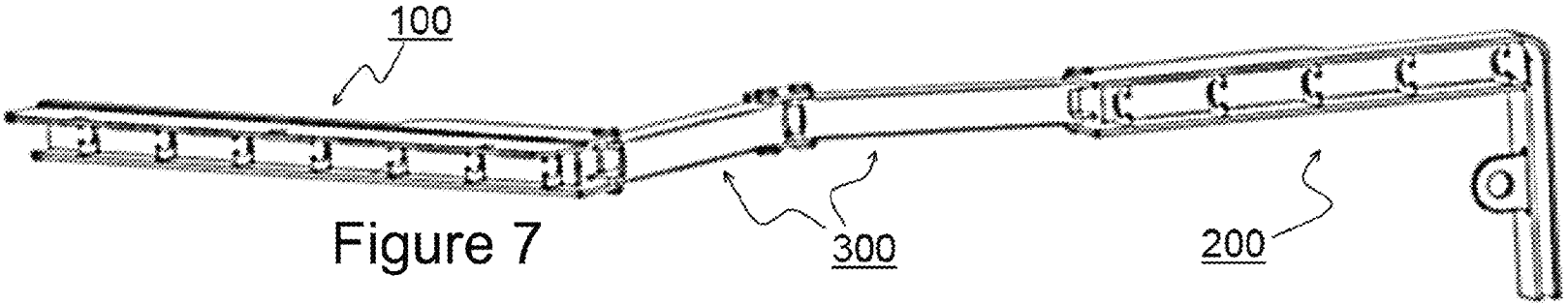
In FIG. 7, the isometric view of the rear section of the guiding device which is preferably invisible by the user is given. The home appliance and the hinge are not illustrated.

In FIG. 6, the preferred embodiment of the connector (400) used in the present invention is illustrated. The connector (400) can be optionally used in every pivot point of the guiding device (40). For this reason, the elements, which have to be connected in the related rotation point, are connected indirectly by the connector (400). However, in the preferred embodiment, the connector (400) only connects the adjacent bridge elements (300) when pluralities of bridge elements (300) are used (FIGS. 7 and 8).

The connector (400) comprises a wall (440) between the upper face (410) and the bottom face (420) parallel with respect to each other, and said wall (440) extends orthogonally with respect to said faces. The upper face (410) and the bottom face (420) have a quadrangular and preferably a rectangular area. The wall (440) joins only a single edge of the quadrangles. Thus, the three lateral faces of the connector (400) are open. The wall (440) moreover has an arc form; it does not have a flat form. Thus, it presents a wider area during folding of the transfer element (30).

Since the connector (400) is used for interconnecting two elements, on each of the upper face (410) and of the bottom face (420), there are two pin housings (430), two pins or one pin-one pin housing (430). The preferred connector (400) comprises two pin housings (430) on each face (410, 420).

On the outside face of the wall (440) of the connector (400), there is a strength element (441) extending along the wall (440). It is preferably in the form of an orthogonal prism formed in an integrated manner in the intermediate section of the wall (440) (FIG. 6).

All of the elements of the guiding device (40) are preferably obtained from a flexible and resistant material like plastic. However, a material known in the related art can also be used.

There is preferably a strength element (131, 231, 431) around the periphery of all the pin housings (130, 230, 430) provided in the invention. The strength element (131, 231, 431) is formed by keeping the material thickness around the pin housing (130, 230, 430), which is in hole form, wider than the other regions (FIGS. 3, 4 and 6).

The pins (310) are placed to the pin housings (130, 230, 430) of the door element (200), the body element (100), the connector (400) and/or the adjacent bridge element (300). Thus, said pivot connections are provided. The upper face (311) of the pins (310) present in the invention is preferably formed in inclined manner. Thus, during the assembly of the guiding device (40), the faces (102, 104, 203, 204, 410, 420) having pin housings (130, 230, 430) can advance on the upper face (311) of the pin (310) by sliding. Thus, the assembly process is facilitated.

In the preferred embodiment, only the bridge element (300) comprises a pin (310). Therefore, the height of the lateral faces (306) of the bridge element (300) is shorter than the inner height of the bridge housings (120, 220) and shorter than the height between the upper face (410) and the bottom face (420) of the connector (400). Thus, the ends of the bridge element (300) can enter into the related gaps.

The transfer element (30) used in the present invention and described above with reference to the figures is preferably an electrical cable. However, it can be a different purpose cable or a fluid pipe.

Both of the connection sections (110, 210) provided in the body element (100) and the door element (200) can optionally be a long plate as the connection section (110) or a ring as the connection section (210).

When the preferred guiding device (40) having two bridge elements (300) is desired to be assembled;

The body element (100) is fixed to the body (10) thanks to the connection section (110), A bridge element (300) is pushed into the bridge housing (120) from a corner of the bridge housing (120) where the pin housing (130) is provided through the end thereof where the pin (310) is provided, and the pins (310) exit out of the pin housings (130) outwardly from the bridge housing (120), The free end of the bridge element (300) is pushed into the connector (400) in the same manner, the pins (310) are placed to the pin housings (430) of the connector (400); however, here connection is realized such that the wall (440) of the connector (400) is at a point far from the door (20) as in FIG. 1, Afterwards, the second bridge element (300) is connected to the other pin housings (430) of the connector (400) in the same manner, The free end of the second bridge element (300) is connected in the same manner to the bridge housing (220) of the door element (200), Finally, the door element (200) is fixed to the door (20).

However, the door element (200) is preferably fixed to such a point that even if the door (20) is opened completely, the angle of the two bridge elements (300) in a manner facing the door (20) is equal to 180 degrees or smaller than 180 degrees. Moreover, when the connector (400) is connected as described, it prevents said angle from being more than 180 degrees.

| REFERENCE NUMBERS | |
|---|---|
| 1. | Home appliance |
| 10. | Body |
| 11. | Front frame |
| 20. | Door |
| 21. | Hinge |
| 30. | Transfer element |
| 40. | Guiding device |
| 100. | Body element |
| 102. | Upper face |
| 104. | Bottom face |
| 106. | Wall |
| 110. | Connection section |
| 111. | Connection hole |
| 120. | Bridge housing |
| 130. | Pin housing |
| 131. | Strength element |
| 140. | Groove |
| 141. | Support element |
| 200. | Door element |
| 201. | First section |
| 202. | Second section |
| 203. | Upper face |
| 204. | Bottom face |
| 205. | Wall |
| 210. | Connection section |
| 211. | Connection hole |
| 212. | Support wall |
| 220. | Bridge housing |
| 230. | Pin housing |
| 231. | Strength element |
| 240. | Groove |
| 241. | Support element |
| 300. | Bridge element |
| 302. | Upper face |
| 304. | Bottom face |
| 306. | Lateral face |
| 310. | Pin |
| 311. | Upper face |
| 400. | Connector |
| 410. | Upper face |
| 420. | Bottom face |
| 430. | Pin housing |
| 431. | Strength element |
| 440. | Wall |
| 441. | Strength element |

The invention claimed is:

1. A home appliance, comprising:

a body;

a door connected to the body with a hinge;

a transfer element configured to provide at least one of a fluid and an electrical connection between the body and the door; and a guiding device structured to guide the transfer element between the body and the door, wherein the guiding device comprises a body element fixed to the body, a door element fixed to the door, and at least one bridge element connected to the body element or the door element, and wherein the at least one bridge element defines a channel and the transfer element passes between the body element and the door element within said channel, wherein the at least one bridge element further comprises a series of bridge elements, each of the series of bridge elements being pivotally connected to each other such that a first bridge element of the series of bridge elements is pivotally connected to the body element and a last bridge element of the series of bridge elements is pivotally connected to the door element, and wherein the guiding device is structured to direct the transfer element from the body to the door separately from the hinge.

2. A home appliance according to claim 1, wherein the guiding device comprises a connector providing a connection at at least one connection point of the guiding device.

3. A home appliance according to claim 2, wherein the connector comprises a pin housing or a pin providing the connection with the first bridge element and the body element or with the last bridge element and the door element.

4. A home appliance according to claim 1, wherein at least one of the body element and the door element each comprises a pin housing or a pin providing a connection with a corresponding one of the series of bridge elements.

5. A home appliance according to claim 1, wherein at least one of the series of bridge elements comprises a pin or a pin housing provided on at least one end of the bridge element.

6. A home appliance according to claim 3, wherein when the connector comprises the pin housing, the pin housing further comprises a strength element provided around the pin housing.

7. A home appliance according to claim 3, wherein when the connector comprises a pin, an upper face of the pin is inclined.

8. A home appliance according to claim 5, wherein a face of the bridge element comprising the pin or the pin housing is longer than a face of the bridge element not comprising the pin or the pin housing, and wherein an excess part of the longer face of the bridge element comprises the pin or the pin housing.

9. A home appliance according to claim 1, wherein the body element comprises a groove structured to guide the transfer element from the body to the first bridge element connected to the body element.

10. A home appliance according to claim 1, wherein the door element comprises a groove structured to guide the transfer element to the door from the last bridge element connected to the door element.

11. A home appliance according to claim 9, wherein the groove comprises a C-shaped support element structured to hold the transfer element in the groove.

12. A home appliance according to claim 1, wherein the body element comprises a connection section to connect the body element to the body.

13. A home appliance according to claim 1, wherein the door element comprises a connection section to connect the door element to the door.

14. A home appliance according to claim 1, wherein each of the series of bridge elements has a pipe-like form structured to guide the transfer element.

15. A home appliance according to claim 1, wherein the transfer element comprises at least one of a cable and a pipe.

16. A home appliance according to claim 1, wherein at least one of the body element and the door element comprises a bridge housing, the series of bridge elements being disposed in the bridge housing when the door is in a closed position.

17. A home appliance according to claim 1, wherein the home appliance is a refrigerator.

18. A guiding device structured to guide a transfer element between a body and a door of a home appliance, the transfer element configured to provide at least one of a fluid and an electrical connection between the body and the door, and the door and the body being connected with a hinge, the guiding device comprising:

a body element structured to be fixed to the body;

a door element structured to be fixed to the door; and at least one bridge element connected to the body element or the door element, said at least one bridge element further comprising a series of bridge elements, each of the series of bridge elements being pivotally connected to each other such that a first bridge element of the series of bridge elements is pivotally connected to the body element and a last bridge element of the series of bridge elements is pivotally connected to the door element, wherein the series of bridge elements defines a channel that is structured to allow the transfer element to pass between the body element and the door element within said channel, and wherein the guiding device is structured to direct the transfer element from the body to the door separately from the hinge.

19. A guiding device according to claim 18, further comprising a connector providing a connection at at least one connection point of the guiding device.

20. A guiding device according to claim 19, wherein the connector comprises a pin housing or a pin providing the connection with the first bridge element and the body element or with the last bridge element and the door element.

21. A guiding device according to claim 18, wherein at least one of the body element and the door element each comprises a pin housing or a pin providing a connection with a corresponding one of the series of bridge elements.

22. A guiding device according to claim 18, wherein at least one of the series of bridge elements comprises a pin or a pin housing provided on at least one end of the bridge element.

23. A guiding device according to claim 20, wherein when the connector comprises the pin housing, the pin housing comprises a strength element provided around the pin housing.

24. A guiding device according to claim 20, wherein when the connector comprises a pin, an upper face of the pin is inclined.

25. A guiding device according to claim 22, wherein a face of the bridge element comprising the pin or the pin housing is longer than a face of the bridge element not comprising the pin or the pin housing, and wherein an excess part of the longer face of the bridge element comprises the pin or the pin housing.

26. A guiding device according to claim 18, wherein the body element comprises a groove structured to guide the transfer element from the body to the first bridge element connected to the body element.

27. A guiding device according to claim 18, wherein the door element comprises a groove structured to guide the transfer element to the door from the last bridge element connected to the door element.

28. A guiding device according to claim 26, wherein the groove comprises a C-shaped support element structured to hold the transfer element in the groove.

29. A guiding device according to claim 18, wherein the body element comprises a connection section to connect the body element to the body.

30. A guiding device according to claim 18, wherein the door element comprises a connection section to connect the door element to the door.

31. A guiding device according to claim 18, wherein each of the series of bridge elements has a pipe-like form structured to guide the transfer element.

32. A guiding device according to claim 18, wherein at least one of the body element and the door element comprises a bridge housing, the series of bridge elements being disposed in the bridge housing when the door is in a closed position.

* * * * *